United States Patent [19]

Valente

[11] Patent Number: 4,893,451

[45] Date of Patent: Jan. 16, 1990

[54] APPARATUS FOR LAYING TILES

[75] Inventor: Pietro Valente, Windsor, Canada

[73] Assignee: Antonietta Investments Ltd., Windsor, Canada

[21] Appl. No.: 97,579

[22] Filed: Sep. 17, 1987

[30] Foreign Application Priority Data

Sep. 18, 1986 [CA] Canada ..... 518519

[51] Int. Cl.[4] ..... E01C 19/14

[52] U.S. Cl. ..... 52/749; 52/747; 404/99

[58] Field of Search ..... 404/99, 73; 52/747, 52/749

[56] References Cited

U.S. PATENT DOCUMENTS

| | | | |
|---|---|---|---|
| 1,825,320 | 9/1931 | Fuerts | 404/99 |
| 2,184,906 | 12/1939 | Buhrmann | 404/99 |
| 4,106,259 | 8/1978 | Taylor-Smith | 52/749 |
| 4,227,834 | 10/1980 | Crowe | 404/99 |
| 4,583,343 | 4/1986 | Camp | 52/749 |

FOREIGN PATENT DOCUMENTS

| | | | |
|---|---|---|---|
| 158538 | 1/1983 | Fed. Rep. of Germany | 404/99 |
| 224351 | 7/1985 | Fed. Rep. of Germany | 404/99 |
| 8503510 | 7/1987 | Netherlands | 404/99 |
| 612991 | 6/1978 | U.S.S.R. | 404/99 |
| 657108 | 4/1979 | U.S.S.R. | 404/99 |
| 779492 | 11/1980 | U.S.S.R. | 404/99 |

*Primary Examiner*—Michael Safavi

*Attorney, Agent, or Firm*—Foley & Lardner, Schwartz, Jeffery, Schwaab, Mack, Blumenthal & Evans

[57] ABSTRACT

The disclosure describes an apparatus for laying tiles or the like on a surface. The apparatus holds the tile over a surface portion which is covered with an adhesive material and on which the tile is intended to be laid, and allows it to contact the adhesive. A vibration is produced so that when the tile is in contact with the surface portion covered with the adhesive material, it becomes embedded therein thereby being fixed on the surface portion. Thereafter, the tile is released. The apparatus advantageously replaces the common practice of laying tiles by hand.

8 Claims, 2 Drawing Sheets

APPARATUS FOR LAYING TILES

BACKGROUND OF INVENTION (1) Field of the Invention

This invention relates to an apparatus for laying tiles or the like. More particularly, the invention relates to a device which enables to lay tiles on a surface with ease and uniformity, and has the advantage that the work can be done by an inexperienced worker.

(2) Description of the prior art

The laying of tiles on a surface, such as a floor or a wall, is normally carried out by hand. To do this, the surface is first covered with an adhesive material such as a cement or a mortar, and the tile is placed in its proper location and is lightly knocked down into the adhesive material until it attains the exact position which is desired. This, of course, needs highly skilled workers and is quite time-consuming. In addition, no matter what care is being taken to cover a surface with tiles, it is nearly impossible to achieve near perfection in this type of work.

It is therefore an object of the present invention to provide an apparatus which enables an unskilled laborer to lay tiles on a surface at low cost and with high efficiency.

It is another object of the present invention to provide an apparatus which enables to produce a tile-covered surface which is near perfect.

SUMMARY OF THE INVENTION

These and other objects of the present invention can be achieved by means of an apparatus for laying tiles or the like on a surface which comprises a body means associated with the body for holding a tile over a surface portion covered with an adhesive material, the surface portion being intended to receive the tile and for allowing the tile to contact the adhesive, vibration means also associated with the body, operative when the tile is in contact with the surface portion covered with the adhesive material to cause the tile to become embedded in the adhesive material thereby being fixed on the surface portion, and means enabling the holding means to release the tile after the latter has been fixed on the surface portion.

In accordance with a preferred embodiment of the invention, the apparatus additionally comprises levelling means enabling to lay the tile along horizontal or vertical levels.

In accordance with another embodiment of the invention, the apparatus comprises joint spacer means enabling to space a tile from a neighboring tile, a distance corresponding to the predetermined width of a joint to be formed between two adjacent tiles.

According to another preferred embodiment of the invention, the holding means comprises a suction cup mounted on the body and means to operatively connect the cup to an air compressor, the suction cup being capable of holding the tile when operatively connected to the air compressor and of releasing the tile when contact with the air compressor is closed.

According to another embodiment of the invention, the vibration means comprises a vibrator mounted in the body to induce a vibration in the body, the vibration being thereby communicated to the suction cup and consequently to the tile when the latter is being laid on the surface portion.

According to another preferred embodiment of the invention, the body comprises an enclosure, the latter comprising the vibrator and a vacuum generator. The vacuum generator is operatively connected to the suction cup for operating it. A handle is mounted on the enclosure, air outlet means are provided on the handle for connection to the air compressor by means of an air hose. An air duct is provided in the handle which also includes a manifold. The latter is connected to the air duct and has a first and a second outlet. A first air connection is provided between the first air outlet and the vacuum generator, and a second air connection is provided between the second air outlet and the vibrator. There is a vacuum valve at the first air outlet and a vibrator valve at the second air outlet, so that by opening the vacuum valve, the vacuum generator becomes operative to enable the suction cup to hold a tile, and by opening the vibration valve, the vibrator induces a vibration in the enclosure to cause the tile to vibrate when being laid onto the surface portion.

According to another preferred embodiment of the invention, the apparatus comprises a pair of extendable arms laterally extending from the enclosure on its front and back sides, adjustable legs at the ends of the arms, bubble levels on the arms to adjust the horizontal level of the tile, the extendable legs enabling to place at least one leg on a tile which has already been laid while at least another leg is directly placed on the surface portion.

According to another preferred embodiment of the invention, there are provided joint spacers dependent from each arm and parallel with the legs to enable to correctly space a tile relative to adjoining tiles so as to form a joint with the predetermined width.

According to another preferred embodiment of the invention, the apparatus comprises a rectangular side arm which is perpendicular to both extendable lateral arms, and an adjustable leg is provided on the outer side of the rectangular side arm. The rectangular side arm is provided with joint spacers which are dependent from both lateral sides of the rectangular side arm, and second bubble levels to adjust the vertical level of a tile mounted on a wall.

According to yet another preferred embodiment of the invention, the apparatus comprises a secondary rectangular handle laterally projecting from the enclosure opposite the rectangular side arm to further help in placing a tile in a proper location.

BRIEF DESCRIPTION OF THE DRAWINGS

The invention will now be illustrated by means of the annexed drawings which are given only by way of illustration and in which.

DESCRIPTION OF THE PREFERRED EMBODIMENTS

Figure 1:
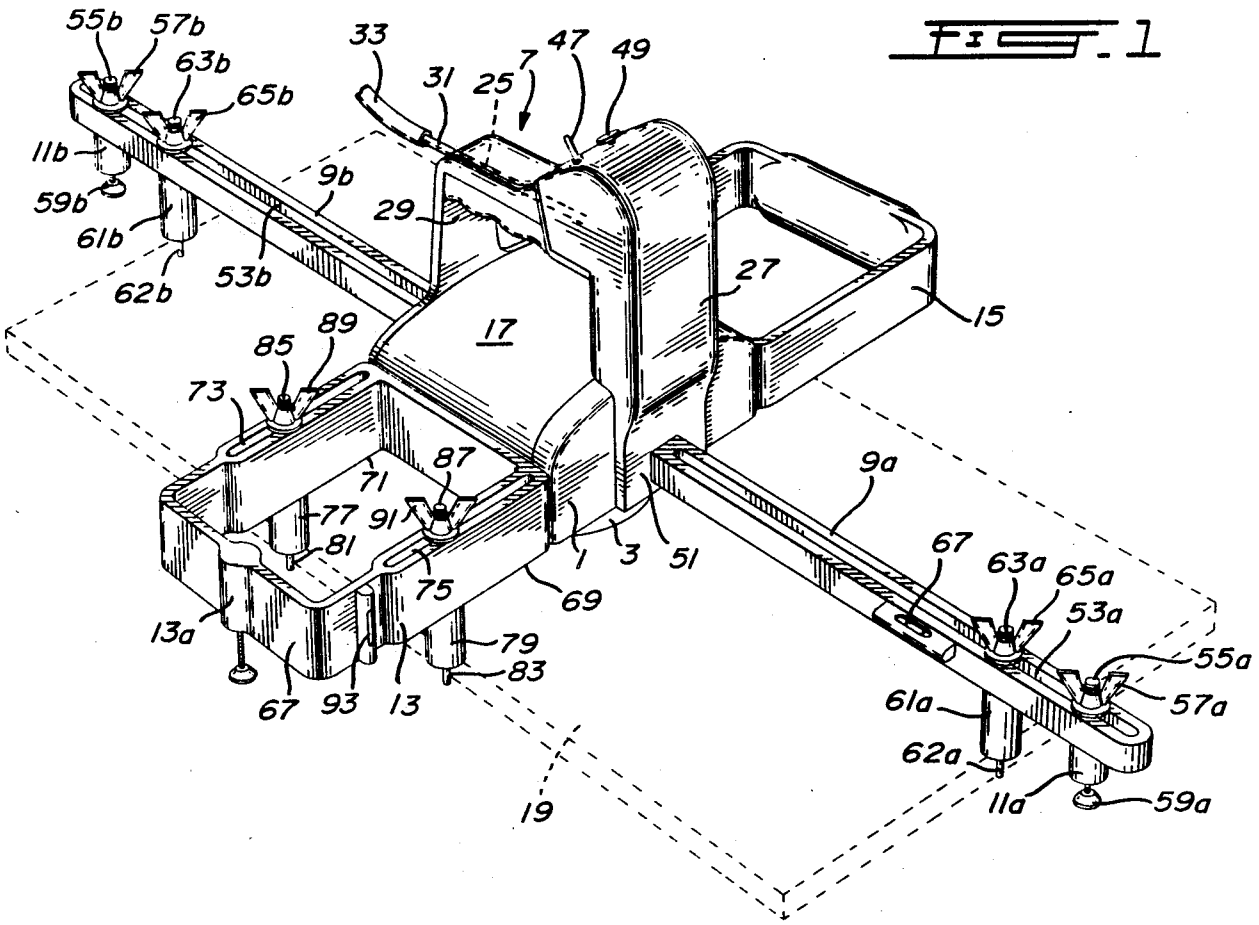
FIG. 1 is a perspective view of a device according to the invention.

With reference to the drawings, it will be seen that the apparatus according to the invention mainly consists of enclosure 1, a suction cup 3, a vibrator 5, a control handle 7, laterally extendable arms 9*a* and 9*b*, each provided with corresponding extendable legs 11*a*, 11*b*, rectangular side arm 13 also provided with an extendable leg 13*a*, and a secondary placement handle 15.

More particularly, the enclosure 1 has the general shape of a box with the top 17 being slightly curved mainly for design purposes.

The suction cup 3 is of a type well known to those skilled in the art with the lowermost portion being shaped somewhat like an inverted teacup so as to hold a tile 19, as shown in FIG. 1. This is made possible by having the suction cup connected to an air compressor (not shown). More details of the operation will be given hereinbelow.

Figure 2:
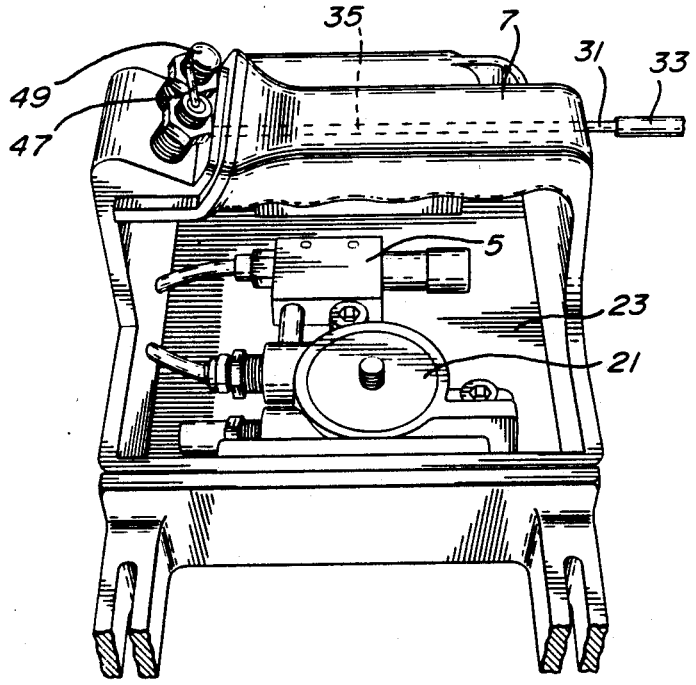
FIG. 2 is a view from the top part of the enclosure being cut away to show its interior.

As shown more particularly in FIGS. 1 and 2, the suction cup 3 is operatively connected in known manner to a vacuum generator 21 of standard construction, and both the vibrator 5 (of known construction) and the vacuum generator 21 are mounted in known manner on the base 23 of the enclosure 1. It will therefore be seen by any one skilled in the art that once the vibrator 5 starts to vibrate, this will produce a corresponding vibration in the entire enclosure 1 and therefore the suction cup 3 will start to vibrate.

Figure 3:
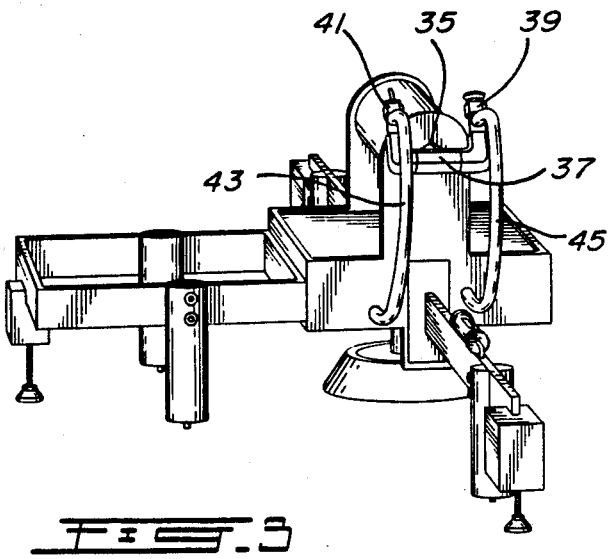
FIG. 3 is a view showing air ducts and controls associated with the vacuum generator and the vibrator.

The U-shaped control handle 7 consists of an upper straight bar 25 and two downwardly extending legs 27,29 fixed in known manner to the enclosure 1. The handle 7 has an air outlet 31 which is intended to be connected to air hose 33 which, in turn, is connected to an air compressor (not shown). An air duct 35 (shown in dotted lines in FIGS. 1 and 2) extends through the upper straight bar 25 of the handle 7 until it reaches a manifold 37 illustrated in FIG. 3, which is connected in known manner to the air duct 35.

The manifold 37 has two air outlets 39,41. In addition there is an air connection 43 between air outlet 41 and the vacuum generator 5, and another air connection 45, the latter being mounted between air outlet 39 and the vibrator 5. At the air outlet 41, there is a vacuum valve 47 (of known construction) and at the outlet 39, there is a vibrator valve 49 (also of known construction). In this manner, when the air hose is connected to the air compressor, the vacuum valve 47 is opened and the vacuum generator 5 becomes operative to enable the suction cup 3 to hold a tile 19 as shown in FIG. 1. Then, by opening the vibrator valve 49, the vibrator 5 starts to induce a vibration in the enclosure 1 to cause the suction cup 3 and thereby the tile 19 to vibrate when the latter is laid on a surface portion.

We shall now describe the front arm 9*a* and the back arm 9*b* which are both identical. The arms 9*a*, 9*b* are mounted in known manner in the enclosure 1 at connection points 51 (only the one for arm 9*a* being shown) provided therefor. As shown, the arms 9*a*, and 9*b* laterally extend from the front back side of the enclosure along a common straight line. Each arm 9*a*, 9*b* comprises an adjustable leg 11*a*, 11*b* which is mounted in a longitudinal slot 53*a*, 53*b* provided in arm 9*a*, 9*b*. The leg is provided with a threaded member 55*a*, 55*b* which extends through the slot 53*a*, 53*b* and the adjustment of the leg 11*a*, 11*b* along arm 9*a*, 9*b* is made possible by tightening the threaded member 55*a*, 55*b* with a wing nut 57*a*, 57*b* at a desired location along the arm 9*a*, 9*b*. Each leg 11*a*, 11*b* is provided with a well known height adjustable pad 59*a*, 59*b*.

In addition to the legs 11*a*, 11*b*, each arm 9*a*, 9*b* is provided with a spacer housing 61*a*, 61*b* terminated by a spacer 62*a*, 62*b*. The upper end of each spacer housing 61*a*, 61*b* is provided with a threaded member 63*a*, 63*b* similar to threaded member 55*a*, 55*b*. The spacers 62*a*, 62*b* can be placed at a desired location by sliding the housing 61*a*, 61*b* along slot 53*a*, 53*b* and tightening it by means of wing nut 65*a*, 65*b*.

A bubble level 67 is mounted in known manner on arm 9*a* to adjust the horizontal level of the apparatus and therefore of the tile 19.

As mentioned above, the apparatus according to the invention also comprises a rectangular side arm 13. As shown, this side arm 13 is rectangular and is mounted in a known manner on the enclosure 1 to be perpendicular to both laterally extending arms 9*a*, 9*b*. The adjustable leg 13*a* is similar to legs 11*a*, 11*b* except that it is not movable along the outer side 67 of the rectangular side arm 13. The two lateral sides 69,71 of the rectangular side arm 13 are formed with slots 73,75 to permit the mounting of spacer housings 77,79 which are similar to housings 61*a*, 61*b*. The spacer housings 77,79 are therefore provided with spacers 81,83, threaded members 85,87 and wing nuts 89,91. In addition, the rectangular side arm is provided with a bubble level 93 to adjust the vertical level of the apparatus and therefore of the tile when tiling a wall.

Finally, as shown in FIG. 1, the apparatus comprises a secondary rectangular handle 15 which laterally projects from the enclosure opposite the rectangular side arm 13. This secondary handle will further assist in placing a tile in a proper location.

According to the invention, the vibrator 5 is used instead of having to knock on the tile 19 until the latter is in proper place, while the tile 19 is still held by the suction cup 3. The vibrator 5 goes on and forces the tile to set in the mortar (not shown) until all air bubbles have been removed and proper location of the tile on the floor or wall has been achieved.

It will be realized that this operation can be carried out by an untrained laborer at very low cost and while achieving a perfect placement of the tile.

It has been mentioned that each extendable arm 9*a*, 9*b* and side arm 13 is provided with joint spacers 61*a*, 61*b*, 81, 83. Each joint spacer has the thickness of a predetermined width of a joint to be formed between two adjoining tiles. So, when placing tile 19 adjacent two other tiles, it is merely necessary to visually rely on the joint spacers to make sure that a space corresponding to the joint to be formed between the two tiles will be left between them.

I claim:

1. Apparatus for laying tiles on a surface in a predetermined arrangement, wherein each tile is laid individually at a given distance from neighboring, already laid tiles, which comprises an enclosure;

holding means mounted on said enclosure for holding a tile over a surface portion covered with an adhesive material, said surface portion being intended to receive said tile, said holding means further permitting said tile to contact said adhesive material;

a pair of extendable arms laterally extending from said enclosure on front and back sides thereof;

an adjustable leg at the end of each of said arms, wherein one of said adjustable legs is placed on a tile which has been laid while the other of said legs is directly placed on said surface portion;

joint spacers dependent from each of said arms and parallel with said legs for correctly spacing a tile relative to adjoining tiles so as to form a joint of predetermined width between adjoining tiles;

vibration means associated with said enclosures and operative when said tile is in contact with said surface portion covered with said adhesive material, said vibration means causing said tile to become embedded in said adhesive material and become fixed on said surface portion; and releasing means enabling said holding means to release said tile after said tile has been fixed on said surface portion.

2. Apparatus according to claim 1, further comprising levelling means for adjusting said enclosure to a horizontal or vertical level.

3. Apparatus according to claim 1, wherein said holding means comprises a suction cup mounted on said enclosure and means to operatively connect said cup to an air compressor, said suction cup being utilized for holding said tile when operatively connected to said air compressor and for releasing said tile when contact with said air compressor is closed.

4. Apparatus according to claim 3, wherein said vibration means comprises a vibrator mounted in said closure to induce a vibration in said enclosure, said vibration being thereby communicated to said suction cup and consequently to said tile when the latter is being laid on said surface portion.

5. Apparatus according to claim 4, wherein said enclosure further comprises a vacuum generator, said vacuum generator being operatively connected to said suction cup for operation of said handle for connection to said air compressor by means of an air hose, an air duct provided in said handle, said handle . also including a manifold, said manifold being connected to said air duct, said manifold having a first outlet and a second outlet, a first air connection between said first air outlet and said vacuum generator, and a second air connection between said second air outlet and said vibrator, a vacuum valve at said first air outlet and a vibrator valve at said second air outlet, so that by opening said vacuum valve, said vacuum generator becomes operative to enable said suction cup to hold a tile, and by opening said vibrator valve, said vibrator induces a vibration in said enclosure to cause said tile to vibrate when being laid onto the surface portion.

6. Apparatus according to claim 5, which further comprises first bubble levels on said arms to adjust the horizontal level of said tile.

7. Apparatus according to claim 6, which comprises a rectangular side arm perpendicular to both said extendable arms, an adjustable leg provided on the outer side of said rectangular side arm, wherein joint spacers are dependent from both lateral sides of said rectangular side arm, and second bubble levels on said rectangular side arm to adjust the vertical level of a tile mounted on a wall.

8. Apparatus according to claim 7, which comprises a secondary rectangular handle laterally projecting from said enclosure opposite said rectangular side arm to further help in placing a tile in a perfect location.

* * * * *